US005394996A

United States Patent [19]

Carpenter

[11] Patent Number: 5,394,996

[45] Date of Patent: Mar. 7, 1995

[54] CARD DISPLAY

[75] Inventor: Robert R. Carpenter, Liberty Center, Ohio

[73] Assignee: Robarb's Ltd., Liberty Center, Ohio

[21] Appl. No.: 181,657

[22] Filed: Jan. 14, 1994

[51] Int. Cl.[6] ..... A47F 7/00

[52] U.S. Cl. ..... 211/94; 211/41

[58] Field of Search ..... 211/94, 40, 41, 50; 40/611, 618, 620

[56] References Cited

U.S. PATENT DOCUMENTS

| | | | |
|---|---|---|---|
| 382,143 | 5/1888 | Curzon | 40/618 X |
| 1,203,712 | 11/1916 | Dietz | 40/618 |
| 1,887,591 | 11/1932 | Fugita | 40/618 |
| 4,322,001 | 3/1982 | Hurley . | |
| 4,573,749 | 3/1986 | Massaro | 211/40 |
| 4,979,619 | 12/1990 | Hager . | |
| 5,010,673 | 4/1991 | Connor et al. . | |
| 5,046,616 | 9/1991 | Makowski et al. . | |
| 5,119,574 | 6/1992 | King . | |
| 5,133,450 | 7/1992 | Rademacher . | |
| 5,148,925 | 9/1992 | Althoff et al. | 211/94 X |
| 5,224,600 | 7/1993 | Neugebauer . | |
| 5,257,472 | 11/1993 | Harnois et al. | 40/618 X |
| 5,259,517 | 11/1993 | Pancoe | 211/41 |

*Primary Examiner*—Alvin C. Chin-Shue
*Assistant Examiner*—Sarah L. Purol
*Attorney, Agent, or Firm*—Marshall & Melhorn

[57] ABSTRACT

A cardholder display is provided which includes a display base and parallel rows of mounting track secured to the base. The mounting track is spaced apart for receiving and displaying baseball cards mounted in cardholders. The mounting track is made from a flexible, resilient material to permit for flexing of the mounting track to receive and to remove the cardholders. The cardholders may be inserted between the mounting track by sliding the cardholders in from either end of the track, or by flexing the track and snapping the cardholder into place at the desired location on the mounting track. The typical display will include three to five pairs of parallel track mounted on the base. Each pair of parallel track will receive and display four to six cardholders. The cardholders with the cards inside may be displayed and inspected without handling the cards.

10 Claims, 2 Drawing Sheets

CARD DISPLAY

BACKGROUND OF THE INVENTION

1. Field of the Invention

The present invention relates to a card display, and more particularly, to a display frame for mounting and displaying individual cardholders for baseball cards or other similar pictures.

2. Summary of Related Art

Baseball cards have been collected for a number of years. When the cards were initially issued, the cards were collected by young boys as a hobby. In recent years, baseball cards have become a major hobby and/or business for both children and adults, with many baseball card collections now being worth thousands of dollars. Baseball cards are traded in sport specialty shops and card shows throughout the country.

Baseball cards are made from a thin card board which is easily bent or disfigured. It is important to protect baseball cards from damage by exposure to the elements or by periodic handling. A well preserved baseball card is worth more to a collector, both in terms of personal satisfaction and monetary value.

As the popularity of baseball card collection and the value of the individual baseball cards has increased, collectors began to keep their baseball cards in special clear plastic cardholders. One of the first cardholder cases for baseball cards was disclosed in U.S. Pat. No. 4,322,001 to Hurley. The two piece construction was provided with a snap fit to protectively seal the baseball card.

U.S. Pat. No. 4,979,629 to Hager shows a cardholder with additional spacing about the card to limit damage to the card once the card is enclosed in the cardholder.

In the last two years, there have been several improvements to the cardholders. U.S. Pat. No. 5,010,673 to Connor et al discloses a card holder with special recesses and mating protrusions to facilitate convenient stacking of the cardholders. The cardholders can also be fitted with a bracket to support the cardholder in an upright position for displaying the single card in the cardholder.

The cardholder in U.S. Pat. No. 5,133,450 to Rademacher provides a snap fit enclosure with close tolerances to seal the card. A notch is provided to permit the separation of the front and back sections of the cardholder.

U.S. Pat. No. 5,224,600 to Neugebauer discloses a cardholder with a special base having a lip extending around the periphery of the base. The lip forms a pocket for receiving a card. The cover includes a snap fit to seal the card between the base and the cover of the cardholder.

As the popularity of baseball card collecting and trading has increased, a need has developed for a display means to display and exhibit the baseball cards in the cardholders. The cardholders with baseball cards are typically maintained in a storage box designed to store the cardholders. In order to view or display the baseball card in the cardholder, the cardholder must be removed from the storage box and held by the viewer or placed on a table or other display surface.

Baseball card collectors desire a display means which can be used to display cards in a safe and attractive wall mounting or display stand. Baseball card traders desire a display means which facilitates the display of the cards to attract potential buyers and permits quick and easy access to baseball cards in cardholders.

In a card store or at a trade show, vendors and traders desire a means for displaying the desired cards for sale. Buyers like to view the card and inspect both sides of the card before buying the card. Such stores and shows also have a number of people who might like to handle the cards, but are not really interested in buying the cards. Vendors require a means for displaying the cards whereby the cards remain in the cardholders for protecting the cards.

Special collector's albums and display plaques have been designed for use by baseball card collectors. U.S. Pat. No. 5,046,616 discloses a diamond shaped plaque with nine cardholders for receiving and holding baseball cards. The cardholder is an integral part of the display plaque and a separate cover snaps over the integral base of the cardholder to protect the card. When an individual card is to be inspected in detail or read on the back of the card, the card must be handled to remove the card from the cardholder.

U.S. Pat. No. 5,119,574 shows a binder having a plurality of pockets to receive collectible display items, such as baseball cards. Pockets are formed within the display pages for insertion of the baseball card. A transparent lid or cover is snapped in place to retain the card. The pages of the album are also made from transparent plastic to permit viewing the card from both front and back without having to remove the card from the pocket.

In addition to baseball cards, the cardholders are used for storing and protecting cards for other sports and for musicians/entertainers. Such cards could obviously be placed in a cardholder and then mounted in the cardholder for display purposes.

Cardholders have also been used to preserve and protect regular photographs that might typically be mounted in a photo album. Photographs, such as school pictures, could also be used in the cardholders.

SUMMARY OF THE INVENTION

In accordance with the present invention, there is provided a cardholder display means consisting of a display base and parallel rows of mounting track secured to the base. The mounting track is spaced apart for receiving and displaying baseball cards mounted in cardholders.

The mounting track is made from a flexible material for acceptance of the cardholders. The cardholders may be inserted between the mounting track by sliding the cardholders in from either end of the track, or by flexing the track and snapping the cardholder into place at the desired location on the mounting track.

The mounting track includes a U-shaped longitudinal channel on both the top and bottom track. The track is space apart at the desired distance to accommodate the standard size cardholders.

The cardholders are maintained in place by the outer channel wall of the track. The track may be a plastic track secured to a wood or fiber board base. The base and the track may also be integrally formed from various plastic materials. The track may include a spring clamp in the channel to more tightly maintain the cardholders between the tracks.

In order to prevent cardholders from sliding out of either end of the tracks, a frame is provided with a raised edge around the periphery of the base to engage the outer edge of a cardholder. A similar effect is achieved with either a wooden or plastic frame.

The typical display will include three to five pairs of parallel track mounted on the base. Each pair of parallel track will receive and display four to six cardholders. Consequently, a collector could typically mount the cards from one team on the display of the present invention, or merely display the collector's otherwise designated cards in individual cardholders.

An object of the present invention is to provide a card display with frame for displaying a plurality of cards mounted in individual cardholders. The display base of the present invention may be provided for either wall mounting or table stand display.

An additional object of the present invention is to provide a card display which displays the cards in individual cardholders. The cards may be handled and inspected through the cardholders without damaging the baseball cards.

A further object of the present invention is to provide mounting track which facilitates the receipt, display, and removal of the cardholders. The cardholders may be slid into the mounting track at either end of the track by flexing the track to slide the cardholder over the retaining ridge. The cardholders may also be flexed to receive and remove cardholders from an interior segment of the mounting track.

An object of the present invention is to have the mounting track engage both the top and bottom ends of the cardholder to secure the cardholder in the desired position. In most cases, the mounting track will accept and secure a majority of the cardholder designs. The mounting track may also be furnished with a channel snap track design such that the mounting track may be used to frictionally retain and secure the cardholders.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
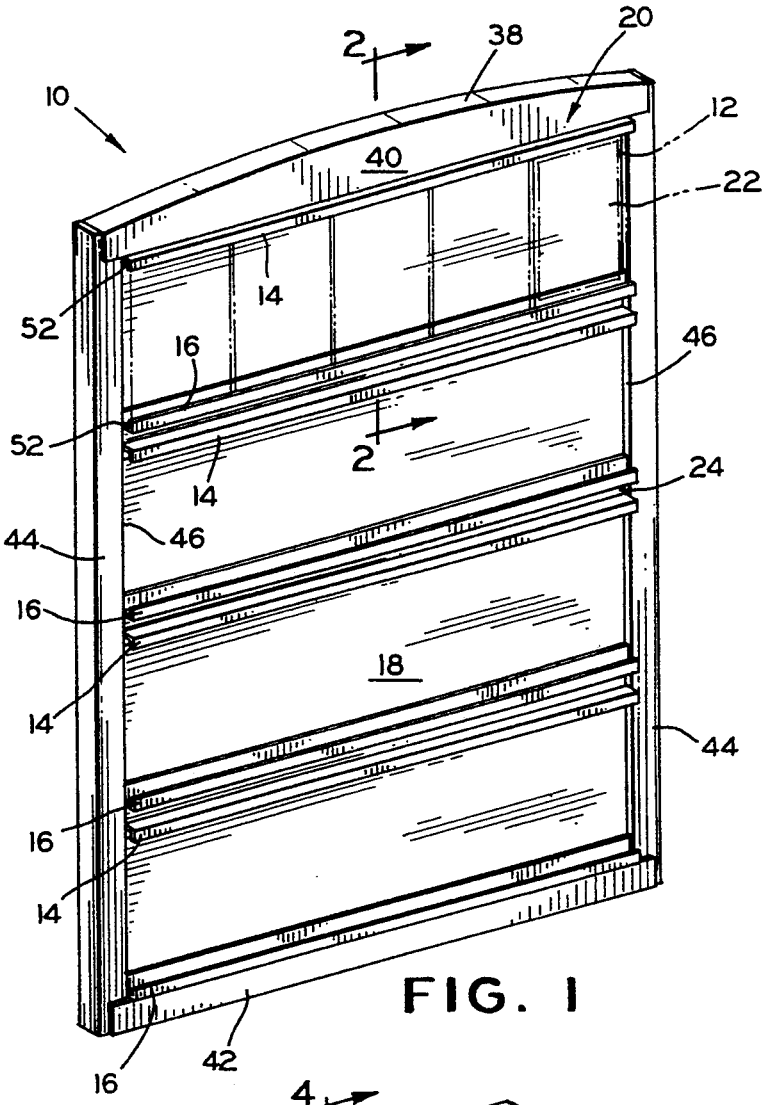
FIG. 1 is a perspective view of the card display of the present invention showing the mounting track used to secure the cardholders, with cards, to the base of the card display.
Figure 2:
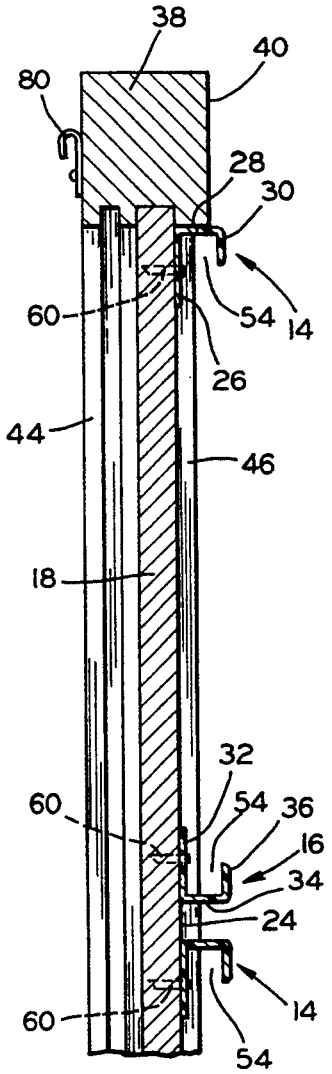
FIG. 2 is a fragmentary cross-sectional view of the display, taken along line 2—2 of FIG. 1, showing the mounting channel and a wooden frame mounted around the periphery of the base.

Referring to the drawings, there is shown in FIGS. 1–2 a card display 10 in accordance with the present invention. The display 10 is used to display plastic cardholders 12 between a pair of mounting track consisting of a top track 14 and a bottom track 16. The tracks 14, 16 include a U-shaped channel and are secured to a base 18. A frame 20 is secured about the periphery of the base 18 to provide an attractive display for baseball cards 22 in individual cardholders 12.

The card display 10 may be mounted on a wall, positioned on a stand, or displayed horizontally on a table top or other display surface. A number of cardholders 12 can be displayed at one time for optimum viewing effect. The cardholders 12 can be easily inserted and removed from the mounting track 14, 16 to view the card 22 through the cardholder 12.

The base 18 of display 10 is a planar surface made from a rigid material, such as wood, fiber board, or plastic. The base 18 is typically rectangular in shape, but the base 18 could be formed in a variety of shapes for display purposes. Fiber board provides a strong, yet light weight and inexpensive base 18. An extruded plastic sheet which is cut to the desired shape. or a molded plastic piece, could also be used to form the base 18 for display 10.

A portion of the front surface 24 of base 18 will be visible from the front of the display 10, such as the segments of the front surface 24 between the bottom track 16 of a first pair of mounting tracks and the top track 14 of an adjacent second pair of mounting track. In addition, the front surface 24 of the base 18 will be visible between the top and bottom tracks of the same pair of mounting tracks when the cardholders are removed. Consequently, the front surface 24 of the base 18 will have a black or wood grain finish to provide an attractive front surface 24. The front surface 24 could also be painted in any other colors, such as one or two colors to match the team colors of a persons favorite team.

Referring now to FIG. 2, the top track 14 and the bottom track 16 are made from a polyvinyl material or other similar material with the desired resilience. The tracks 14, 16 should have some elasticity or flexibility to facilitate the insertion of the cardholders 12 between the tracks 14, 16. The material must also be resilient to resume the original shape of the track 14, 16 to retain the cardholders 12.

If the tracks 14, 16 and the base 18 are both made from polyvinyl material, it may be possible to extrude the base and tracks at the same time such that the tracks are integrally formed in the base 18. Extrusion methods and mold methods to form the base 18 are known in the art.

The top track 14 is a U-shaped configuration and includes a back wall 26, a top segment 28, and a front retention wall 30. The back wall 26 may be glued or fastened by a screw or other fastener to the base 18. The bottom, U-shaped track 16 includes a back wall 32, a bottom segment 34, and a front retention wall 36, and is secured to the base 18 in a similar manner.

FIGS. 1–2 also show the wood frame 20 mounted around the periphery of the base 18. The wood frame 20 includes a top segment 38 with mounting face 40, a bottom segment 42, and two side segments 44. The various segments of the wood frame 20 are secured to the base 18 such that a ridge 46 is formed which extends upward from the edge of the base 18.

The top segment 38 is wider than the other segments to provide a face 40 for the mounting of a nameplate (not shown) at the top of the display 10.

Figure 3:
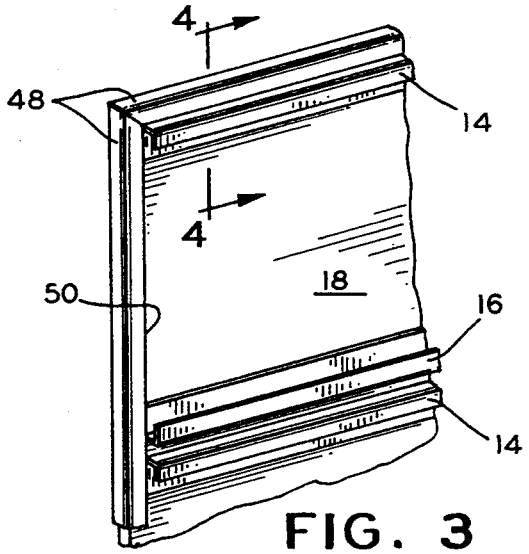
FIG. 3 a fragmentary perspective view of the card display with a plastic frame mounted on the base.
Figure 4:
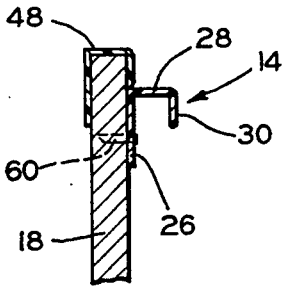
FIG. 4 is a fragmentary cross-sectional view of the base with a plastic frame taken along line 4—4 of FIG. 3.

In addition to the wood frame 20, a polyvinyl frame may also be used with the base 18. FIGS. 3–4 show a segment of the polyvinyl frame 48 secured about the periphery of base 18. The polyvinyl frame 48 also includes a ridge 50 which extends upward from the base 18.

Figure 5:
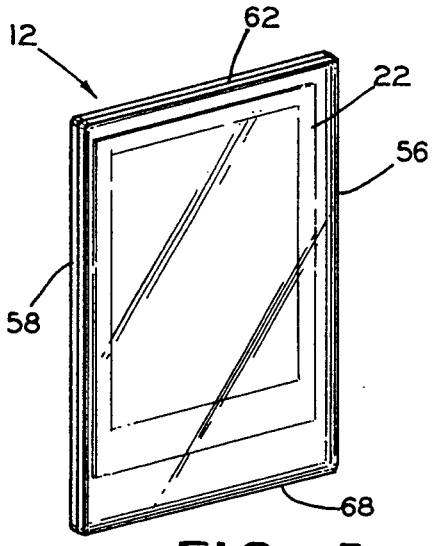
FIG. 5 is a perspective view of a typical cardholder used for protecting baseball cards.

FIG. 5 shows a cardholder 12 with a card 22 mounted inside the cardholder 12 in the known manner. Since 1957, the majority of sports cards 22 have been 2.5 inches wide by 3.5 inches tall. The various cardholders 12 have widths of 2.75 to 3.00 inches and heights of 3.75 to 4.00 inches. The thickness of such cardholders generally ranges from 0.125 to 0.25 inches. The cardholders 12 are made from a clear plastic material to permit viewing of both sides of the card. The cardholders 12 usually include a base and a separate cover which snap together to secure and protect the card 22 in the cardholder 12.

Although the cardholders 12 were designed for baseball and other sport cards, the display 10 of the present invention could be used to display school pictures and other photographs. The spacing of the top track 14 and bottom track 16 could be adjusted to accommodate other size plastic holders.

Figure 6:
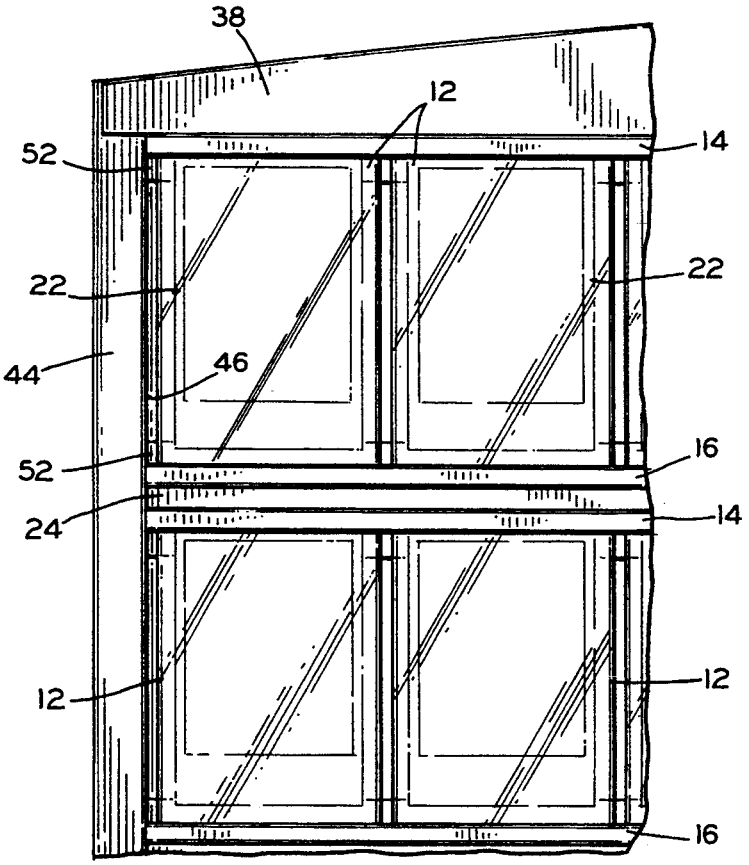
FIG. 6 is an elevational view of a portion of the card display showing the mounting track with the cardholders secured in the mounting track.

In FIG. 6, the top track 14 and the bottom track 16 are mounted in parallel relationship with a spacing of approximately 4.00 inches. Although there is no limit to the length of the tracks 14, 16, most displays have track segments of from 3.00 inches to 24.00 inches to mount from one to eight cardholders 12 per row of track. FIG. 1 shows a common size of display with four rows of parallel top and bottom tracks 14, 16.

The number of rows of parallel track 14, 16 can be varied to provide mounting space for the desired number of cardholders 12. The spacing between the rows of parallel track 14, 16 is set at the time of manufacture of the display 10. The cardholders 12 are slidable within the mounting track 14, 16, so that spacing between cardholders 12 mounted in the same row of parallel tracks 14, 16 may be varied.

The cardholders 12 may be inserted into the tracks 14, 16 of the display 10 in several different methods. The tracks 14, 16, as shown in FIG. 1 and FIG. 6, are open at the end 52 of the tracks 14, 16. The open end 52 is typically adjacent the ridge 46 formed by the side 44 of frame 20. The ridge 46 acts as a stop to prevent the cardholders 12 form sliding out the open end 52 of the mounting tracks 14, 16 after the cardholders 12 have been inserted. The front walls 30, 36 of the channel in tracks 14, 16 is flexible such that one edge 56 of cardholder 12 could be wedged into the gap 54 between the ridge 46 and the outer walls 30, 36 such that the outer walls 30, 36 would flex to permit the cardholder to be pushed into the display position as shown in FIG. 6. After the cardholder 12 is between the tracks 14, 16, the front edge would return to its original position to prevent the cardholders 12 from accidently sliding out. The cardholders 12 could be removed at the open end by lifting up the opposite side edge 58 of the cardholder 12 to clear the ridge 46 and then sliding the cardholder 12 from the tracks 14, 16.

A second means for inserting and removing cardholders 12 at the open end 52 of the track 14, 16 would be to allow one to two inches of track to remain free from the base, for example, by inserting fasteners 60 not at the end 52 of the track 14, 16, but approximately two inches in from the open end. This would permit the complete track 14, 16, including the back walls 26, 32 to temporarily be flexed from the base 18 to permit entry of the side edge 54 into the channel of the track 14, 16 and the sliding of the cardholder 12 past the ridge 46, at which time the tracks would be relaxed to return to a linear configuration with the back walls 26, 32 engaging the base 18. The flexing process is reversed to slidingly remove the outside cardholder 12 from the tracks 14, 16.

Figure 7:
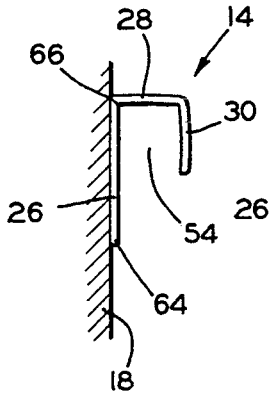
FIG. 7 is a cross-sectional view of the top mounting track showing a standard U-shaped channel for securing the cardholders to the base.

In addition to sliding the cardholders 12 into position at the open end 52, the cardholders may be inserted and removed at any position in the display 10 by a direct snap in/snap out method. To secure a cardholder 12 between the tracks 14, 16, the top edge 62 of the cardholder is insert into the top track 14 (see FIG. 7) at the lower end 64 of the back wall 26 and sliding the top edge 62 up the back wall 26 until the top edge 62 reaches the corner 66. The front wall 30 of the top track 14 will flex outward to accept the cardholder 12. After the top edge 62 of the cardholder 12 reaches the corner 66, the bottom edge 68 is pushed inward to flex inward the front wall 36 of the bottom track 16. Once the bottom edge 68 clears the front wall 36, the front wall 36 will return to its original configuration and the bottom edge 68 of the cardholder 12 is lowered to rest on the bottom segment 34 of the bottom track 16. The front walls 30, 36 overlap the top edge 62 and the bottom edge 68 to retain the cardholder 12 between the mounting tracks 14, 16.

To subsequently remove a cardholder 12 from the display 10, the top edge 62 of the cardholder 12 is slid upward to engage the top segment 28 of the top track 14. The card holder 12 is pivoted about the top edge 62 in corner 66 of the top track 14 until the bottom edge 68 outwardly flexes and subsequently clears the front wall 36 of the bottom track 16. The cardholder 12 can then be lowered at an angle until the top edge 62 clears the top track 14.

Figure 8:
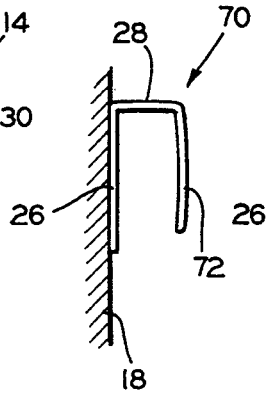
FIG. 8 is a cross sectional view of the top mounting track showing a U-shaped channel with an extended, flexible outer wall for securing the cardholders.
Figure 9:
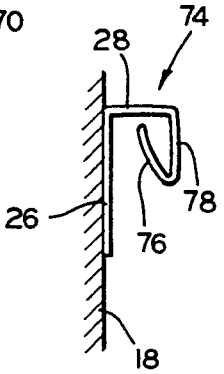
FIG. 9 is a cross-sectional view of the top mounting track showing a U-shaped channel plus a longitudinal spring leg integrally formed with the outer wall to clip the cardholders against the base of the display.

FIGS. 8–9 show alternative embodiments of the top track. In FIG. 8, top track 70 has an extended front face 72, which would facilitate the retention of cardholders of different heights. When the front face is extended to a length of approximately 0.50 inches, the tracks 14, 16 can accommodate cardholders from 3.75 to 4.15 in height, which would include nearly all of the current cardholder models.

One other problem which occasionally occurs is that the mounting tracks 14, 16 are too wide for the cardholders 12. Some wobble between the back wall and front wall of the mounting tracks 14, 16 is acceptable, but when the cardholder 12 is ultrathin, the wobble may become unacceptable. In such cases, a top mounting track 74 which acts as a clip can secure the cardholder 12 against the base 18. The mounting track 74 includes a flexible spring leg 76 integrally formed with front wall 78. When a cardholder 12 is inserted, the spring leg 76 exerts a backward force along the top edge 62 to maintain the cardholder in position against the base 18.

A similar clip mounting track could also be used on the bottom track if additional retaining force was needed. When the mounting track 74 is used with the spring leg 76 to clip the cardholder 12 in place, the retention force exerted on the cardholder 12 is sufficient to permit the parallel track to be mounted at an angle or even vertically on the base 18.

The display 10 includes a wall mounting hook 80 (FIG. 2) or other means for mounting the display 10 on a wall. Collectors and vendors can more effectively display their cards by utilizing the wall mounting capabilities. At trade shows where no walls are available for display, the display 10 can be mounted on a table stand or otherwise positioned on a table for viewing.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A display device for displaying collectable cards in individual cardholders, said display device comprising:

a planar base;

at least one pair of mounting track secured to said planar base, said mounting track including a top track and a bottom track in parallel,spaced-apart relationship, said pair of mounting track each provided with a generally U-shaped channel such that a channel opening of the bottom track faces a channel opening of the top track, the channels of said mounting track being sized and spaced-apart for receiving and selectively securing a plurality of cardholders between said pair of mounting track, and said pair of mounting track being formed from a flexible, resilient material to facilitate the temporary deformation of the track for receiving and for removing cardholders between the top and bottom mounting track; and means for mounting said planar base on a surface for displaying the cards.

2. The display device defined in claim 1 including two or more pairs of mounting track secured to said planar base, said pairs of mounting track positioned in parallel, spaced-apart relationship on said base.

3. The display device defined in claim 1 wherein the top track of said pair of mounting tracks includes an extended outer channel wall to facilitate receiving and retaining cardholders of varying heights between the top and bottom mounting track.

4. The display device defined in claim 1 wherein said base is formed from a polyvinyl material and said pair of mounting tracks is integrally formed from the polyvinyl material.

5. A display device for displaying collectable cards in individual cardholders, said display device comprising:

a planar base;

at least one pair of mounting track secured to said planar base, said mounting track including a top track and a bottom track in parallel, spaced-apart relationship, said pair of mounting track each provided with a generally U-shaped channel such that a channel opening of the bottom track faces a channel opening of the top track, the channels of said mounting track being sized and spaced-apart for receiving and selectively securing a plurality of cardholders between said pair of mounting track;

a frame mounted about a periphery of said planar base, said frame including a ridge upstanding from said planar base, the ridge of said frame abutting a first end and a second end of said pair of mounting track whereby said frame partially closes the U-shaped channels at both ends of said pair of mounting track to secure the cardholders between the top track and the bottom track; and means for mounting said planar base and said frame on a surface for displaying the cards.

6. The display device defined in claim 5 wherein said frame is a wood frame.

7. The display device defined in claim 5 wherein said frame is a polyvinyl frame.

8. A display device for displaying collectable cards in individual cardholders, said display device comprising:

a planar base;

at least one pair of mounting track secured to said planar base, said mounting track including a top track and a bottom track in parallel, spaced-apart relationship, said pair of mounting track each provided with a generally U-shaped channel such that a channel opening of the bottom track faces a channel opening of the top track, the channels of said mounting track being sized and spaced-apart for receiving and selectively securing a plurality of cardholders between said pair of mounting track, the top track of said mounting track including a clip means formed in the top track to secure the cardholder against said base; and means for mounting said planar base on a surface for displaying the cards.

9. The display device defined in claim 8 wherein said clip means includes a spring leg integrally formed with an outer channel wall and extending into the channel of the top track, said spring leg adapted to bear against and secure the cardholder against said base when the cardholder is inserted into the channel of the top track.

10. A display device for displaying collectable cards in individual cardholders, said display device comprising:

a planar base;

at least one pair of mounting track secured to said planar base, said pair of mounting track including a top track and a bottom track in parallel, spaced-apart relationship, and being formed from a flexible, resilient material to facilitate the temporary deformation of the track for receiving and for removing cardholders between the top and the bottom mounting track, said pair of mounting track each provided with a generally U-shaped channel such that a channel opening of the bottom track faces a channel opening of the top track, the channels of said mounting track being sized and spaced-apart for securing a plurality of cardholders between said pair of mounting track;

a frame mounted about a periphery of said planar base, said frame including a ridge upstanding from said planar base, the ridge of said frame abutting a first end and a second end of said pair of mounting track whereby said frame partially closes the U-shaped channels at both ends of said pair of mounting track to secure the cardholders between the top track and the bottom track; and means for mounting said planar base on a surface for displaying the cards.

* * * * *